US005505296A

United States Patent [19]

Parker

[11] Patent Number: 5,505,296

[45] Date of Patent: Apr. 9, 1996

[54] TISSUE CONTAINER AND DISPOSAL CONTAINER ARRANGEMENT

[76] Inventor: Marion H. Parker, 301 E. 78th St., Apt. 18A, New York, N.Y. 10021

[21] Appl. No.: 419,437

[22] Filed: Apr. 10, 1995

[51] Int. Cl.[6] ..... B65D 69/00

[52] U.S. Cl. ..... 206/233; 206/494

[58] Field of Search ..... 206/233, 494, 206/812, 359; 5/658, 503.1

[56] References Cited

U.S. PATENT DOCUMENTS 3,197,062 7/1965 Dag et al. ..... 206/494

3,482,810 12/1969 Bailey ..... 5/503.1

4,879,442 11/1989 Giovine ..... 206/494

FOREIGN PATENT DOCUMENTS 613434 1/1961 Canada ..... 206/494

*Primary Examiner*—Thomas P. Hilliard

[57] ABSTRACT

The tissue container and disposal container arrangement of the invention is arranged to provide for a disposal container readily removed and erected from a collapsed configuration to accommodate soiled tissues subsequent to use. The disposal container is provided with a support tether to permit ease of positioning of the disposal container as desired.

4 Claims, 3 Drawing Sheets

TISSUE CONTAINER AND DISPOSAL CONTAINER ARRANGEMENT

TECHNICAL FIELD

The field of Invention relates to tissue container structure, and more particularly to a tissue container and disposal container arrangement permitting the ease of disposal of soiled tissue subsequent to use.

BACKGROUND OF THE INVENTION

Prior art tissue containers are readily available in the prior art, with a container having a disposal housing through a bottom wall thereof, as indicated in U.S. Pat. No. 5,129,545, with attendant awkwardness in use.

Further such examples are indicated in the U.S. Pat. Nos. 5,145,062 and Design patents 312,934 and 344,425.

SUMMARY OF THE INVENTION

The tissue container and disposal container arrangement of the invention is arranged to provide for a disposal container readily removed and erected from a collapsed configuration to accommodate soiled tissues subsequent to use. The disposal container is provided with a support tether to permit ease of positioning of the disposal container as desired.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
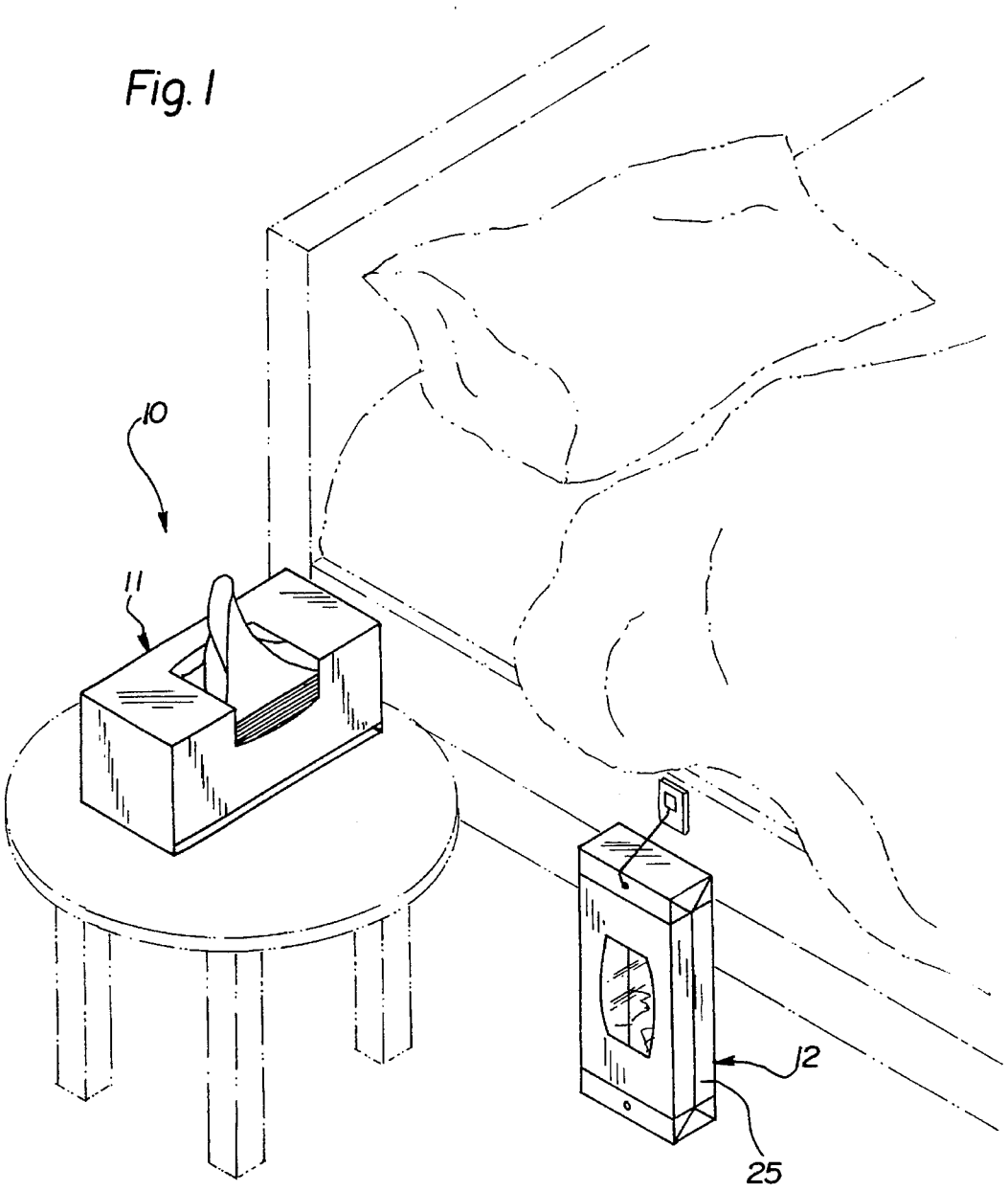
FIG. 1 is a perspective illustration of the invention
Figure 2:
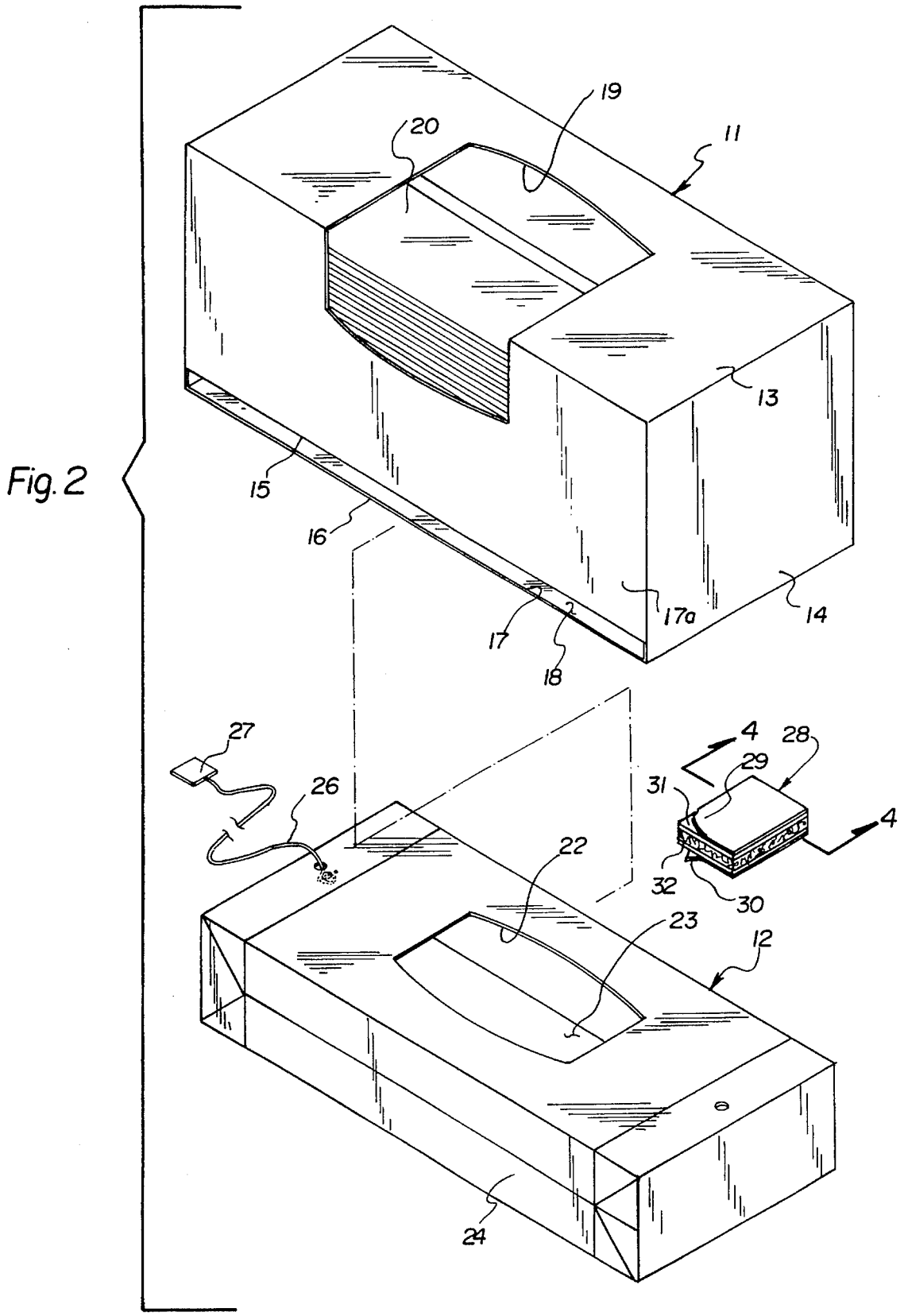
FIG. 2 is a perspective exploded illustration of the invention.
Figure 3:
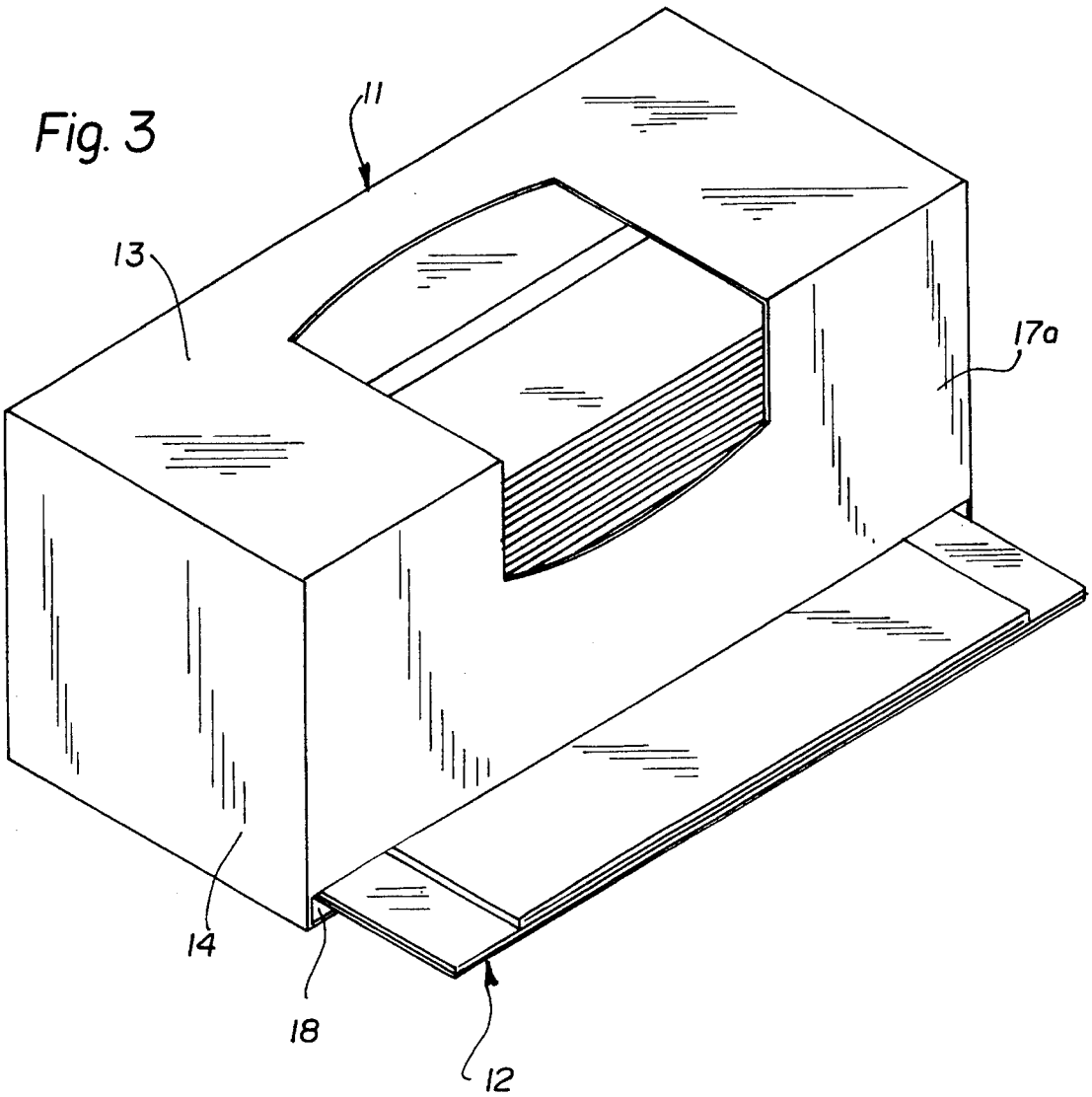
FIG. 3 is a perspective illustration of the disposal container in an interfolded configuration arranged for removal from the pocket of the first container.
Figure 4:
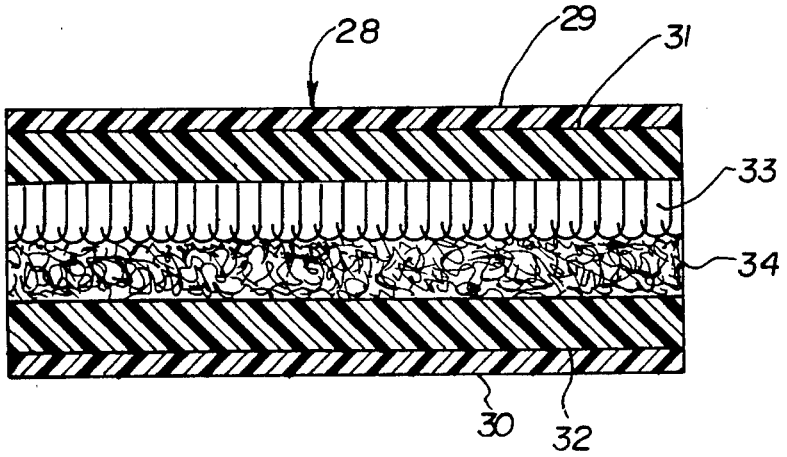
FIG. 4 is a cross-sectional illustration taken along the lines 4—4 as indicated in FIG. 2.

The container and disposal container arrangement 10 of the invention, as indicated in the FIGS. 1 and 2 includes a first container 11 having a first container top wall 13, first container spaced side walls 14, a first container bottom wall 15, and a first container floor 16 spaced from the first container bottom wall 15 to define an entrance slot 17 for access to a storage cavity pocket 18 between the first container bottom wall 15 and the first container floor 16. As understood, the first container is provided with a rear wall to define the pocket structure 18 and to this end, the second container 12 is in an interfolded first position arranged for storage within the pocket 18, in a manner as indicated in FIG. 3. The first container is provided with a first container opening 19 directed into the first container for access to tissue members 20 contained within the first container cavity for ease of removal of such tissue members for use.

The second container 12 is arranged for being stored in an interfolded first position, such as noted above and as illustrated in FIG. 3, to an erected second position such as illustrated in the FIGS. 1 and 2 for example. To this end, the second container is provided with a second container top wall 21, a second container entrance opening 22 through the top wall 21 for access to a storage cavity 23 within the second container 12 when the second container is in the second position. Pleated front and rear walls 24 and 24 (see FIGS. 1 and 2) permit the container to be interfolded and subsequently erected as illustrated. Further, a tether cord 26 is secured to the second container 12 and extends to a fastener pad 27 at a distal end of the tether cord 26 remote from the second container. An anchor pad 28 is provided having first and second portions, with the respective first and second portions having respective first and second peel-away layers 29 and 30 on opposed sides of the first and second portions for exposing respective first and second adhesive surfaces 31 and 32. The first adhesive surface 31 is typically arranged for fastening to a support surface, such as that illustrated in FIG. 1, with the second adhesive surface 32 arranged for adhering the fastening pad. First and second hook and loop fastener layers 33 and 34 project from the first and second portions for selective securement relative to one another to permit ease of removal of the storage container as desired, for either disposal or for emptying as may be desired by a user thereof.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by LETTERS PATENT of the United States is as follows:

1. A tissue container and disposal container arrangement, comprising, a first container and a second container, the first container having a first container cavity and tissue members removably positioned within the first container cavity, with the first container having a first container opening for access to the first container cavity, and the first container having a pocket means for selectively receiving the second container, the second container arranged for storage within the pocket means in a first interfolded position of the second container, and the second container arranged for erection to a second position to define a second container cavity;

a tether line having a tether line first end secured to the second container, and a free tether line second end unattached to the second container, with a fastener pad secured to the second end.

2. An arrangement as set forth in claim 1 wherein the second container includes a second container top wall, having a second container opening for access to the second container cavity when the second container is in the second position.

3. An arrangement as set forth in claim 2 wherein the second container includes a pleated front wall and a pleated rear wall permitting interfolding of the second container into the first position.

4. An arrangement as set forth in claim 1 including an anchor pad, the anchor pad having a first portion and a second portion, with the first portion having a first adhesive surface for adherence to a support member, and the second portion having a second adhesive surface for selective adherence to the fastener pad, and the first portion having first securement means and the second portion having second securement means, with the first securement means and the second securement means arranged for selective securement relative to one another.

* * * * *